United States Patent [19]

Manikian et al.

[11] Patent Number: 4,498,808

[45] Date of Patent: Feb. 12, 1985

[54] PROCESS FOR PREVENTION OF ICE BUILDUP AND REDUCTION OF ICE FORCES ON STRUCTURES DURING BREAKUP

[75] Inventors: Victor Manikian; Giles N. McDonald, both of Anchorage, Ak.

[73] Assignee: Atlantic Richfield Company, Los Angeles, Calif.

[21] Appl. No.: 479,416

[22] Filed: Mar. 28, 1983

[51] Int. Cl.[3] ..... E02B 3/00; E02B 15/02

[52] U.S. Cl. ..... 405/61; 405/211

[58] Field of Search ..... 405/61, 211, 217; 114/40, 42

[56] References Cited

U.S. PATENT DOCUMENTS 2,449,963 9/1948 Ward ..... 405/61

3,742,715 7/1973 Nolte ..... 405/61

*Primary Examiner*—David H. Corbin

*Attorney, Agent, or Firm*—Roderick W. MacDonald

[57] ABSTRACT

A method for aiding the prevention of ice jamming at a man-made structure, and lessening the force exerted on these structures in a body of flowing water wherein a plurality of side-by-side slots are cut in the ice cover prior to substantial melting of same thereby reducing the size of and lessening the strength of ice floes which form during seasonal warm-up which causes thawing and breakup of the ice cover.

4 Claims, 7 Drawing Figures

PROCESS FOR PREVENTION OF ICE BUILDUP AND REDUCTION OF ICE FORCES ON STRUCTURES DURING BREAKUP

BACKGROUND OF THE INVENTION

Increasing development in the Arctic and sub-Arctic has emphasized the need to minimize the adverse effects of seasonal breakup in the ice cover of rivers and lakes. These effects include the flooding caused by ice jams and the impact of ice on structures such as man-made bridges and natural obstacles such as rocks and fallen trees.

Ice jam floods are usually associated with the spring breakup period when seasonally warming temperatures melt the winter snow cover and dramatically increase the flow in rivers and streams. Most of the larger streams have at this time seasonal ice covers ranging from a few inches to more than 20 feet in thickness. Typically the ice cover at the start of breakup is composed of cold, consolidated, strong ice. Much of the winter ice cover is frozen fast to the stream bed and banks. The early breakup water flow is often over this ice surface. As the breakup flow increases and the seasonal ice cover warms and weakens, the ice releases from the bed and banks and begins to float downstream with the current. These floating sheets of ice may be quite large. They may have widths equal to the winter width of the stream or river channel and lengths up to the length of the straight river reach in which they were formed. This length may typically be four or five times the width of the ice flow. The thickness of these sheets of consolidated ice may approach the maximum winter ice thickness.

Frequently, in larger rivers, these large, strong sheets of ice (ice floes) impinge and ground (stop) on a downstream stream channel man-made structures such as bridges, natural features such as a bend in the river or gravel bar. Small ice floes accumulate at the upstream edge of the original ice sheet. If the momentum of the arriving ice floes is sufficiently high, they may be drawn undeneath. If not, they accumulate upstream. The stream flow deepens and the velocity of the water decreases until such time as an equilibrium ice jam thickness develops. This ice jam may or may not completely block the stream. Damage results from injury to man-made structures such as bridges, flooding, and, occassionally, diversion of the ice itself to overbank property. The ice jam will persist until such time as the strength of the ice cakes are not sufficient to overcome the internal stress in the jam imposed by the increase in river stage.

Another source of damage occurs when moving ice floes impact on man-made hydraulic structures such as bridge piers, wharfs, or river training works. The force exerted by ice on these structures is often the dominant force for which Arctic riparian structures must be designed. The destruction of an ice floe by a vertical small hydraulic structure such as a bridge pier occurs in different ways, depending most on the stored kinetic energy of the floe and the ice strength. Upon impact, an ice floe is first locally crushed. If the floe cannot be diverted, the floe will continue to fail either by splitting or, for large floes, by crushing. If an ice floe strikes a structure, the energy transmitted to the structure is made up of the energy of deformation inside the ice floe and the energy required for crushing of the ice. The energy of deformation is negligible compared with the energy of crushing for cases approaching design conditions. A fundamental relationship of physics provides that the acceleration of the ice sheet is proportional to the resultant force on the structure and is applied in the same direction as the force. A second fundamental relationship provides that the force exerted on the structure by indenting and crushing ice is the product of the crushing strength of the ice and the edge area of the crushed ice sheet. From the above two relationships, one may derive the maximum horizontal force which a structure must exert to stop an ice floe. This force is a function of both the size and strength of the approaching ice sheets. There is a minimum mass of ice floe necessary before the maximum crushing force can be developed. Similar relativity exists for ice failure in the tensile and shearing modes. However, the crushing mode is usually the most severe condition. From the above, it can be seen that it is desirable to reduce the size of strength of the ice floes.

The crushing, as well as the shearing and flexural strength of an ice cover, is a function of the crystal structure of the ice which is in turn a function of the temperature of the ice. With increasing temperature, the ice tends to reform its crystal structure towards large vertically oriented crystals. The impurities in the ice tend to concentrate at the crystal boundaries forming wet surfaces which are easily split. As a result, the crushing strength of ice is close to zero at the melting point but rises rapidly in proportion to about eight tenths power of the decrease in temperature below freezing.

Ice may be warmed and thus weakened as a result of one or all of the following physical processes, each of which may be significant during the spring breakup period. Heat may be transferred to an ice mass as a result of condensation of moisture in the air on the ice surface, by solar radiation, and from the adjacent air or water mass. This conductive transfer may be assisted by convention transfer. Heat may be gained because of friction from adjacent flowing water. Other modes of heat transfer exist. The heat transferred to the ice first warms the ice surface and then penetrates into the ice in accordance with the normal laws for heat transfer by conduction. Once the ice reaches the freezing point, any additional heat transferred is absorbed in providing the latent heat of fusion requirement, and the ice converts to water.

In the past, several schemes for reducing the strength and mass of the seasonal ice cover prior to breakup have been employed. These techniques have been employed both to reduce the size and strength of the ice floes. One technique is to apply a thin coating of a dark substance such as coal dust, fly ash or silt to darken the ice surface thereby increasing the amount of solar energy absorbed by the ice. This method depends largely on the ice surface remaining snowfree after the application of the dust, etc. as well as upon the weather sequence subsequent to the application.

Another technique employed consists of breaking up the ice cover by means of explosives. This technique has been employed both with explosives placed on or under the ice surface by hand and with explosives droped from airplanes. This method is of limited application because of the impact on fish and other wildlife and because of the risk to man and his property.

A third technique applicable only to large navigable rivers consists of using breaking vessels to break ice jams as they form. This technique is not always useful around bridges and the like.

BRIEF SUMMARY OF THE INVENTION

By this invention, there is provided a method for aiding the prevention of an ice jam at a natural or man-made structure in a body of flowing water, the ice jamming resulting from the ice cover melting and breaking up into ice floes which are then washed by the body of water against the structure, comprising forming in the vicinity of said structure a plurality of side-by-side essentially parallel extending slots in the ice cover before substantial melting of the ice cover occurs. The invention is intended to lessen the force an ice floe can exert on a man-made structure by (a) reducing the size of the floe by mechanical cutting, and (b) reducing the strength of the ice floe by warming the ice so it will crash or split more easily. The slots extend a substantial distance into the thickness of the ice cover and are preferably, although not necessarily, oriented so that their longitudinal axis are essentially parallel to the longitudinal axis of the flow of the body of water. Thus, when seasonal thawing does occur, preferential thawing will occur in the slots so that subsequent breakup of the uniform ice cover will yield to ice floes of a width, because of the slots, which will readily pass by the structure and prevent ice buildup at the structure itself.

Accordingly, it is an object of this invention to provide a new and improved method for weakening seasonal ice cover on a body of water in such a manner that upon subsequent thawing and breakup of the ice cover, buildup of ice floes at a structure in the body of water is prevented and forces exerted on the structure by the ice floes is reduced.

Other aspects, objects and advantages of this invention will be apparent to those skilled in the art from this disclosure and the appended claims.

DETAILED DESCRIPTION OF THE INVENTION

Figure 1:
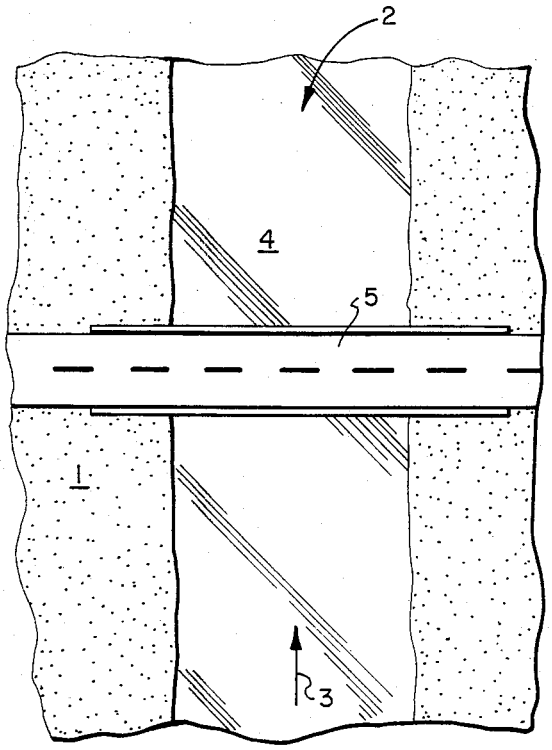
FIG. 1 is a top view of a river with an ice cover and a man-made structure, bridge spanning the river.

FIG. 1 shows the surface of the earth 1 with a flowing river 2 therein, river 2 flowing the direction of arrow 3 and being covered with a comprehensive ice cover 4. River 2 is spanned by a road bridge 5.

Figure 2:
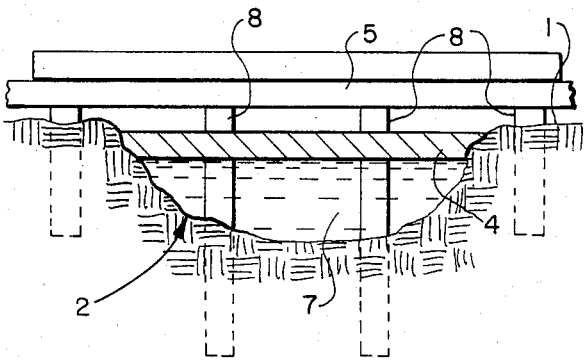
FIG. 2 is an elevational view of the river, ice cover and bridge of FIG. 1.

FIG. 2 shows a cross-section of river 2 comprising ice cover 4 and flowing liquid water 7 thereunder. FIG. 2 also shows that bridge 5 is supported by a plurality of piers 8, some of which extend from bridge 5 through ice cover 4 and water 7 into the earth underlying the bottom of river 2. Thus, those piers 8 provide a substantial obstacle to large ice floes passing down the river 2 in the direction of arrow 3 when ice cover 4 melts and breaks up in the spring season of the year.

Figure 3:
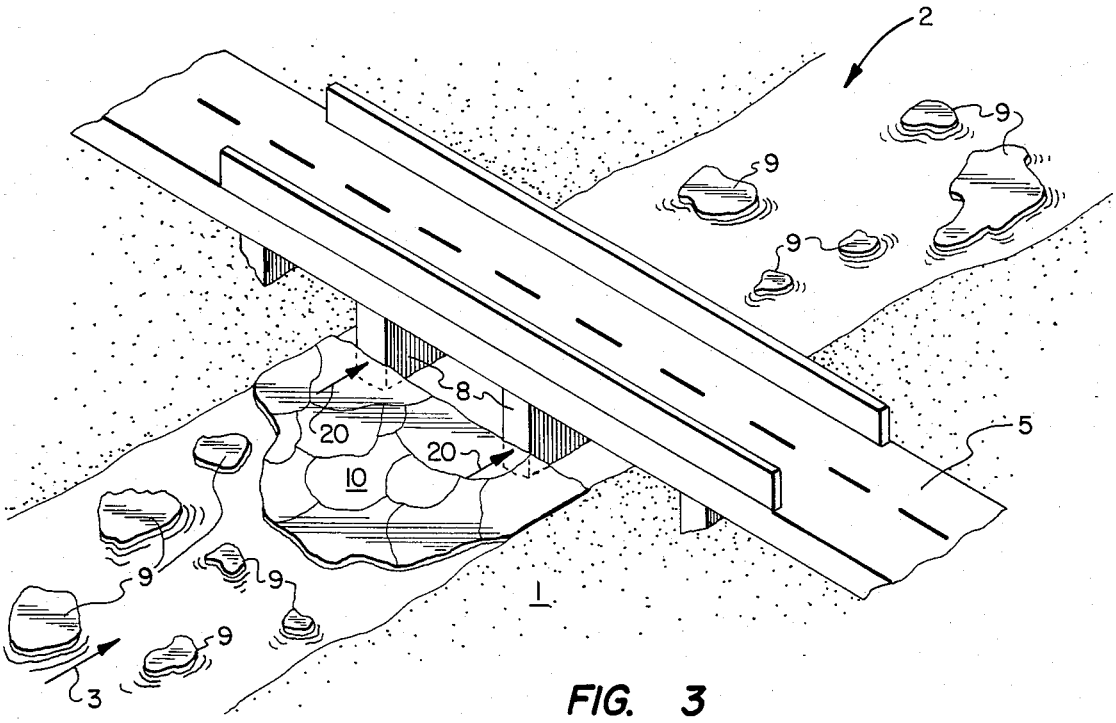
FIG. 3 is an isometric view of the river and bridge of FIG. 1 after the ice cover has thawed, broken up, and formed an ice barrier at the bridge which would normally happen without the practice of this invention.

FIG. 3 shows the situation that normally occurs in the spring when ice cover 4 breaks up into discrete ice floes 9. Normally, when ice cover 4 is allowed to melt and breakup randomly in its own manner, very large floes are sometimes formed which are stopped by piers 8 of bridge 5 resulting in a backup and buildup of ice upstream of bridge 5 as represented by an ice floe buildup 10 which extends completely across river 2. This puts substantial pressure upon piers 8 and can do structural damage to bridge 5 as well as cause flooding upstream of ice buildup 10. It is this sort of result that the invention herein is designed to help prevent.

Figure 4:
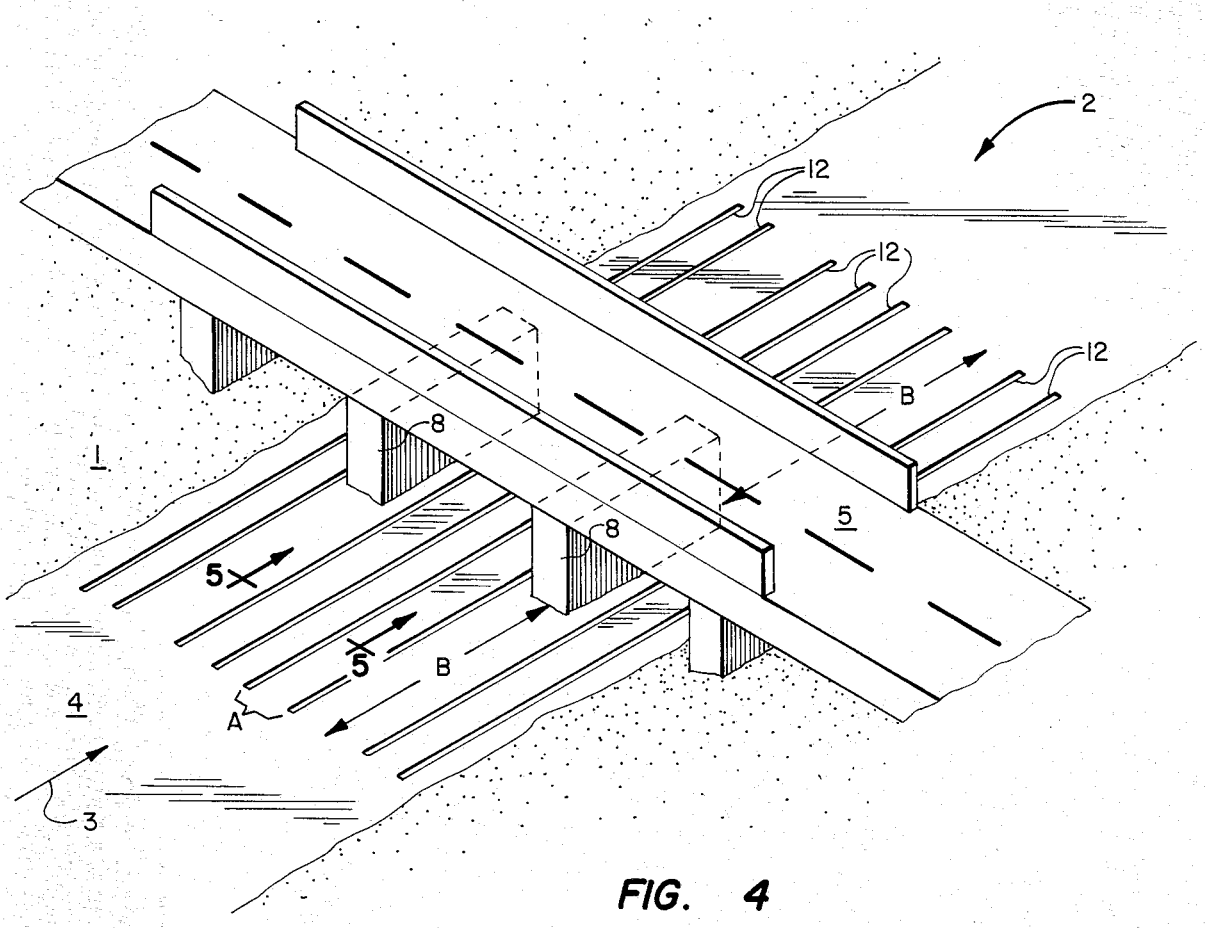
FIG. 4 is an isometric view of the plurality of slots cut in the ice cover in accordance with this invention prior to thawing and breakup of that ice cover.

FIG. 4 shows river 2 while still frozen in the state originally described for FIGS. 1 and 2 prior to any thawing and breakup as shown in FIG. 3. However, in ice cover 4 of FIG. 4, there has been cut therein a plurality of side-by-side, essentially parallel slots 12 which extend a substantial distance into the thickness of ice cover 4 as shown hereinafter with respect to FIG. 5, and which are oriented so that their longitudinal axis are essentially parallel to the longitudinal axis of the flow 3 of river 2. Slots 12 are spaced from one another laterally across the width of river 2 for a distance such that upon thawing of the ice cover 4, the ice will preferentially break apart at slots 12 thereby forming narrower ice floes than would normally be formed by allowing random breakup to occur as shown in FIG. 3 so that the resulting ice floes will be of a width sufficiently narrow, that those floes will readily pass by piers 8 under bridge 5 and on downstream in river 2 without forming an ice buildup 10 and reduction of forces 20 as shown in FIG. 3. Slots 12 extend a substantial distance upstream and downstream of the structure, man-made or natural, of which an ice buildup 10 is to be avoided.

Figure 5:
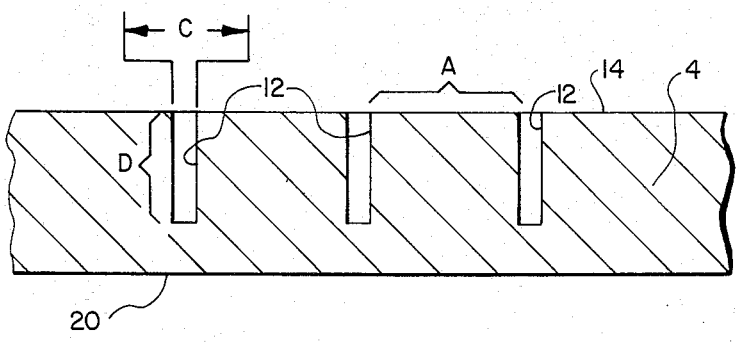
FIG. 5 is a cross-sectional view of the ice cover of FIG. 4 showing the spaced apart slots cut therein in accordance with this invention.

FIG. 5 shows a cross-section of ice cover 4 with three slots 12 cut therein. Side 20 of icecover 4 is, therefore, the bottom side of the ice cover which is adjacent the unfrozen liquid water 7 shown in FIG. 2 whereas side 14 is the top side of ice cover 4 which can be seen in FIG. 4. Slots 12 are spaced laterally apart from one another by a distance A which is sufficent so that when preferential thawing and breakup occurs in ice cover 4 at these slots, relatively narrow ice flows will be formed. This distance A can vary widely depending upon the nature of the body of water and its ice cover and the nature of the man-made or natural structure which is to be avoided by the resulting ice floes. Generally, the slots will be spaced at least five feet from one another, center to center. These slots can be made any width C as desired and which equipment is available for conventional ditching equipment being quite suitable for the practice of this invention. Generally, each slot 12 will be at least one-quarter inch in width. For example, a one-half inch slot cut with a chain saw has been shown to be effective for the purposes of this invention. The slots will extend a distance B, as shown in FIG. 4, which is substantial distance both upstream and downstream from the structure to be avoided, bridge 5 and piers 8 in the end FIG. 4, and this distance B will also vary considerably based on the nature of the water body and its ice cover as well as the structure to be avoided, but generally will extend longitudinally at least 100 feet upstream at least 100 feet downstream of the structure.

Slots 12 should be cut a distance D into ice cover 4 which is sufficient so that the ice will be preferentially weakened at the slots. Depth D of slots 12 can vary considerably and is not critical to the operation of the invention so long as it effects preferential weakening.

Figure 6:
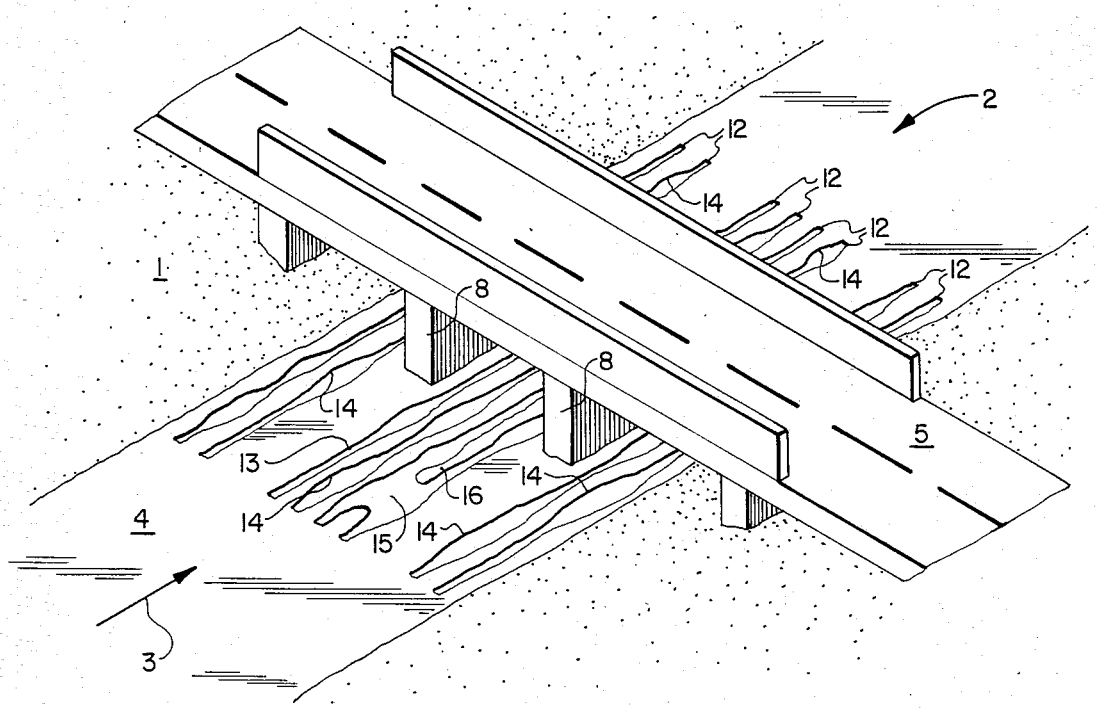
FIG. 6 is an isometric view of FIG. 4 with only two slots showing, for sake of simplicity, how the slots widen during thaw.

FIG. 6 shows the embodiment of FIG. 1 with, for sake of simplicity, only two slots 12 shown even though in actual practice, a large number of slots will be cut as shown in FIG. 4. FIG. 6 shows that state of thawing of ice cover 4 when sufficient of the ice has melted to fill slots 12 with running water 13. Slots 12 serve as a channel for carrying liquid water downstream in the direction of arrow 3 which adds to the thawing of the overall ice cover and helps widen slots 12 as shown at areas 14 until finally, communication is established between two adjacent slots 12 as shown at 15. Thus, it can be seen that by the preferential thawing starting in slots 12, relatively narrow ice flows 16 can be formed which will readily pass longitudinally under bridge 5 between piers 8.

Figure 7:
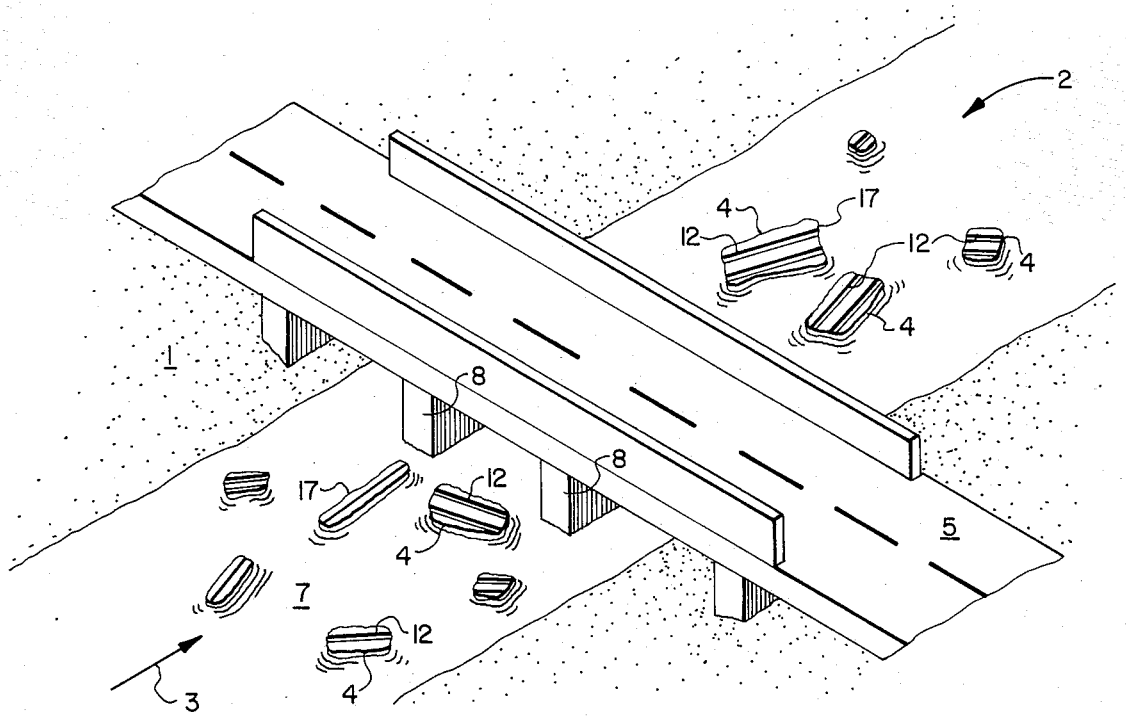
FIG. 7 shows breakup of the ice cover of FIG. 6 and the resulting smaller ice floes, because of the slots cut therein, which do not form an ice buildup at the bridge structure.

This results upon further thawing and considerable breakup of the ice in a result as shown in FIG. 7 wherein substantial amounts of ice cover 4 has broken into individual discrete ice floes 17. Some of the ice floes will contain one or more slots 12 therein but some will be formed as shown for 16 in FIG. 6 of a single strip of ice from between two adjacent slots 12. Also, because of breakthrough melting between adjacent slots 12 as shown for 15 of FIG. 6, the ice flow 17 will be for shortened so that massive floes such as 9 shown in FIG. 3 will not be formed and the broken up ice will more readily pass by piers 8 and under bridge 5 than if random breakup were allowed to occur as shown for FIG. 3. This way, a substantial ice buildup and reduction of ice strength and floe mass at piers 8 as shown in FIG. 3 is avoided by the slot cutting method of this invention.

In the winter season in Alaska, the process of this invention was practiced on a frozen river prior to spring thaw and breakup. The invention was carried out substantially as shown from FIG. 4 of the drawings wherein ice cover 4 was up to about fifteen feet thick at the time of slot cutting. The average temperature of the ice cover was about 25° F. at the time of cutting which is typical to strong ice. Seven inch wide slots were cut with a conventional Ditch Witch trenching machine. The slots were cut to a depth of from about 5.5 to about 6 feet spaced laterally therefrom across the width of the river on from about 12.5 to about 15 foot center. The slots were oriented essentially perpendicular to the longitudinal axis of bridge 5 and extended a distance B about 500 feet upstream from bridge 5 and about 500 feet downstream of bridge 5 and were continuous under bridge 5 so that each slot was a single longitudinally extending slit in the ice of the length of about 1,000 feet plus the width of bridge 5.

The ice cover 4 was then left unbothered until spring thaw came about. As the thaw progressed, the slots interrupted the early surface flow of water over the ice and channeled that flowing water into the slots prior to breakup. The flow of water in the slots at this time was relatively high, especially through the bridge area and as a result, the slots grew in width from the ice melt on the sides of the cut, much as shown in FIG. 6. Heat was thereby transferred to the interior of the ice because of the flow of liquid water in the slots with the result of a substantial reduction in the crushing strength of the ice. This leads to smaller ice floe 17 being formed because of slots 12 as opposed to random breakup as shown for FIG. 3.

During actual breakup of ice cover 4 after substantial thawing of same, the ice cover 4 split preferentially along slots 12. In addition, secondary ice features tended to break laterally so as the width to length ratio of the ice floes was about 1 to 4 as observed during ice breakup. The resulting ice floes were smaller than those encountered during the past few years at the same bridge site in spite of record high ice levels and record high runoff for that particular spring thaw and breakup. For the first time in several years, the breakup flood did not overtop the low level road approaches to the bridge. Although these benefits cannot be attributed solely to the ice cutting program because of a snow removal program that was also carried out in the same area, the ice cutting method of this invention definitely resulted in weaker, smaller ice floes which broke out of the bridge area prior to the main breakup of the ice cover for the river as a whole and thus, contributed to in a substantial manner a lowering of the peak flood stage at that bridge that year.

Reasonable variations and modifications are possible within the scope of this disclosure without departing from the spirit and scope of this invention.

I claim:

1. In a method for aiding the prevention of ice buildup at a structure in a body of flowing water when the ice cover on said body of water starts to melt and breakup, the improvement comprising:

forming at said structure a plurality of side-by-side, essentially parallel slots in said ice cover before substantial melting of same, said slots being oriented so that the longitudinal axis of same is essentially parallel to the longitudinal axis of the flow of said body of water said slots extending a substantial distance both upstream and downstream of said structure and a substantial distance into the thickness of said ice cover, said slots being spaced from one another a distance such that if upon thawing the ice cover breaks apart at said slots the width of the resulting ice floes will readily pass by said structure.

2. The method of claim 1 wherein said slots extend longitudinally at least 100 feet upstream and/or at least 100 feet downstream of said structure.

3. The method of claim 1 wherein said slots are spaced at least 5 feet from one another.

4. The method of claim 1 wherein said slots are at least one-quarter inch in width.

* * * * *